US006679440B2

(12) United States Patent
Igashira et al.

(10) Patent No.: US 6,679,440 B2
(45) Date of Patent: Jan. 20, 2004

(54) VALVE ACTUATING DEVICE AND FUEL INJECTOR USING SAME

(75) Inventors: Toshihiko Igashira, Toyokawa (JP); Masatoshi Kuroyanagi, Kariya (JP); Satoshi Hayashi, Kuwana (JP)

(73) Assignee: Denso Corporation (JP)

( * ) Notice: Subject to any disclaimer, the term of this patent is extended or adjusted under 35 U.S.C. 154(b) by 173 days.

(21) Appl. No.: 09/978,583

(22) Filed: Oct. 18, 2001

(65) Prior Publication Data

US 2002/0050535 A1 May 2, 2002

(30) Foreign Application Priority Data

Oct. 30, 2000 (JP) ..... 2000-329913
Dec. 28, 2000 (JP) ..... 2000-400050

(51) Int. Cl.[7] ..... F02M 59/00; F02M 51/00; B05B 1/30

(52) U.S. Cl. ..... 239/533.2; 239/533.3; 239/585.4; 239/585.5

(58) Field of Search ..... 239/88, 89, 91, 239/533.2, 533.3, 585.1, 585.2, 585.3, 585.4, 585.5; 251/129.15, 129.21, 127, 62

(56) References Cited

U.S. PATENT DOCUMENTS 4,249,499 A * 2/1981 Perr ..... 123/502
4,728,074 A 3/1988 Igashira et al.
4,940,911 A * 7/1990 Wilson ..... 310/87
5,287,829 A * 2/1994 Rose ..... 123/90.12
5,372,114 A * 12/1994 Gant et al. ..... 123/502
5,472,142 A * 12/1995 Iwanaga ..... 239/96
5,779,149 A 7/1998 Hayes, Jr.
6,155,532 A 12/2000 Heinz et al.

FOREIGN PATENT DOCUMENTS

DE 19807903 A1 9/1999
DE 19844996 A1 4/2000
EP 0816670 A1 1/1998

* cited by examiner

*Primary Examiner*—Davis Hwu
(74) *Attorney, Agent, or Firm*—Nixon & Vanderhye PC

(57) ABSTRACT

A valve actuating device is provided which may be employed in fuel injectors for automotive internal combustion engines. The valve actuating device includes an actuator, a large-diameter piston displaced by said actuator, a small-diameter piston operating a valve, a displacement amplifying chamber filled with working fluid to amplify and transmit displacement of the large-diameter piston to the small-diameter piston, and a drain passage. The drain passage communicates with the displacement amplifying chamber through a pinhole for draining the working fluid within the displacement amplifying chamber, thereby enabling the pressure in the displacement amplifying chamber to be released in order to ensure the movement of the small-diameter piston when the valve actuating device is started.

16 Claims, 3 Drawing Sheets

PIEZO-VOLTAGE
NORMAL
FAILURE

PRESSURE IN CHAMBER 6 (MPa)
FAILURE (NO PINHOLE)
FAILURE (PINHOLE)
NORMAL
UNDERSHOOT

LIFT OF VALVE 52 (mm)

PRESSURE IN CHAMBER 4 (MPa)

LIFT OF NOZZLE NEEDLE 12 (mm)
TIME(ms)
t1
t2
t3
t4
t5
t6

VALVE ACTUATING DEVICE AND FUEL INJECTOR USING SAME

BACKGROUND OF THE INVENTION

1. Technical Field of the Invention

The present invention relates generally to a valve actuating device equipped with an electrically operated actuator and a fuel injector for internal combustion engines equipped with such a valve actuating device.

2. Background Art

Hydraulic fuel injectors equipped with a piezoelectric valve actuator are used in internal combustion diesel engines of automotive vehicles. Such a fuel injector includes a large-diameter piston moved by the expansion and contraction of the piezoelectric valve actuator, a pressure chamber filled with hydraulic fluid, and a small-diameter piston which are arranged in alignment with each other. The movement of the large-diameter piston causes the hydraulic fluid in the pressure chamber to change in pressure, which moves the small-diameter piston. The small-diameter piston then actuates a control valve.

When it is required to emit a fuel spray, the piezoelectric valve actuator is energized so that it expands to increase the hydraulic pressure in the pressure chamber through the large-diameter piston. This causes the expansion of the piezoelectric valve actuator to be amplified hydraulically and transmitted to the small-diameter piston. The small-diameter piston then moves downward and opens the control valve. When the control valve is opened, it will cause the pressure in a back pressure chamber to drop, thereby lifting up a nozzle needle to initiate fuel injection. Contracting the piezoelectric valve actuator will cause the small-diameter piston to move upward, thereby closing the control valve to terminate the fuel injection.

There is known the above type of fuel injector which has disposed therein a hydraulic mechanism designed to supply working fluid to the pressure chamber through a check valve in order to compensate for a leakage of working fluid from the pressure chamber. For example, U.S. Pat. No. 5,779,149 to Hayes, Jr. teaches a fuel injector which has formed therein a fluid passage serving to direct the fuel leaking from a nozzle needle to a pressure chamber through a check valve made up of a ball valve and a coil spring. U.S. Pat. No. 6,155,532 (corresponding to Japanese Patent First Publication No. 11-166653) teaches a fuel injector which has a refill valve disposed in a radial direction of a pressure chamber for compensating for a leakage of fuel from the pressure chamber. The refill valve is, like the above structure, made up of a ball valve and a coil spring.

The above structures, however, have three drawbacks as discussed below.

(1) The pressure chamber being filled with the working fluid after assembly of the fuel injector, air may be left in the pressure chamber, thus resulting in instability of operation of the fuel injector. (2) The small-diameter piston falls downward by the gravity while the fuel injector is at rest for a long period of time, so that an amount of working fluid equivalent to a change in volume of the pressure chamber is supplied to the pressure chamber through the check valve, thereby making it difficult to lift up the small-diameter piston, which disenables a subsequent operation of the fuel injector. (3) If power supply to the piezoelectric valve actuator is cut undesirably during expansion of the piezoelectric valve actuator, it becomes impossible for the piezoelectric valve actuator to contract, thus resulting in the pressure in the pressure chamber being kept at higher levels, which causes the fuel to continue to be sprayed from the fuel injector. Further improvement of controllability and safety of fuel injectors is, therefore, sought.

SUMMARY OF THE INVENTION

It is therefore a principal object of the invention to avoid the disadvantages of the prior art.

It is another object of the invention to provide an improved structure of a valve actuating device which assures higher controllability and safety in operation and a fuel injector equipped with such a valve actuating device.

According to one aspect of the invention, there is provided a valve actuating device which may be used in a fuel injector for automotive internal combustion engines. The valve actuating device comprises: (a) an actuator; (b) a first piston displaced by the actuator; (c) a second piston operating a valve, the second piston being smaller in diameter than the first piston; (d) a displacement amplifying chamber provided between the first piston and the second piston, the displacement amplifying chamber being filled with working fluid to amplify and transmit displacement of the first piston to the second piston; and (e) a drain passage communicating with the displacement amplifying chamber through a pinhole for draining the working fluid within the displacement amplifying chamber.

In the preferred mode of the invention, the diameter of the pinhole is within 0.02 to 0.5 mm.

A check valve is disposed between the displacement amplifying chamber and the drain passage which allows the working fluid to flow only from the drain passage to the displacement amplifying chamber. The check valve includes a flat valve in which the pinhole is formed.

The first piston has formed therein a passage leading to the drain passage. The pinhole is provided between the passage and the displacement amplifying chamber.

The first piston has a length in which the passage extends longitudinally and has an opening formed in a first end of the length exposed to the displacement amplifying chamber. The flat valve of the check valve is disposed on the opening of the passage to allow the working fluid to flow only from the drain passage to the displacement amplifying chamber through the passage. The pinhole is formed in the flat valve of the check valve.

An oil sump is formed on a side of a second end of the first piston opposite the first end and establishes fluid communication between the drain passage and the passage.

A spring chamber is formed on the side of the first end of the first piston in which a spring is disposed to urge the actuator away from the displacement amplifying chamber. The spring chamber defines the oil sump.

According to another aspect of the invention, there is provided a fuel injector which may be employed in automotive internal combustion engines. The fuel injector comprises: (a) an injector body; (b) a fuel inlet passage formed in the injector body; (c) an actuator; (d) a first piston displaced by the actuator; (e) a second piston smaller in diameter than the first piston, the second piston operating a valve for spraying fuel supplied from the fuel inlet passage from a spray hole; (f) a displacement amplifying chamber formed between the first piston and the second piston within the injector body, the displacement amplifying chamber being filled with working fluid to amplify and transmit displacement of the first piston to the second piston; and (g)

a drain passage formed in the injector body which communicates with the displacement amplifying chamber through a pinhole for draining the working fluid within the displacement amplifying chamber.

In the preferred mode of the invention, the displacement amplifying chamber is filled with the working fluid at a factory.

The working fluid is injected into the displacement amplifying chamber at the factory after the displacement amplifying chamber is evacuated.

The injector body is sealed to avoid leaking of the working fluid in the displacement amplifying chamber out of the injector body.

BRIEF DESPCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is a plan view of FIG. 2(*a*);

FIG. 2(*c*) is a perspective view which shows a conical spring of a check valve;

FIG. 3(*b*) is a time chart which shows the pressure in a displacement amplifying chamber;

FIG. 3(*c*) is a time charts which shows the amount of lift of a ball valve used to control the pressure in a control chamber;

FIG. 3(*d*) is a time chart which shows the pressure in a control chamber;

FIG. 3(*e*) is a time chart which shows the amount of lift of a nozzle needle;

FIG. 4(*b*) is a plan view of FIG. 4(*a*).

DESCRIPTION OF THE PREFERRED EMBODIMENTS

Figure 1:
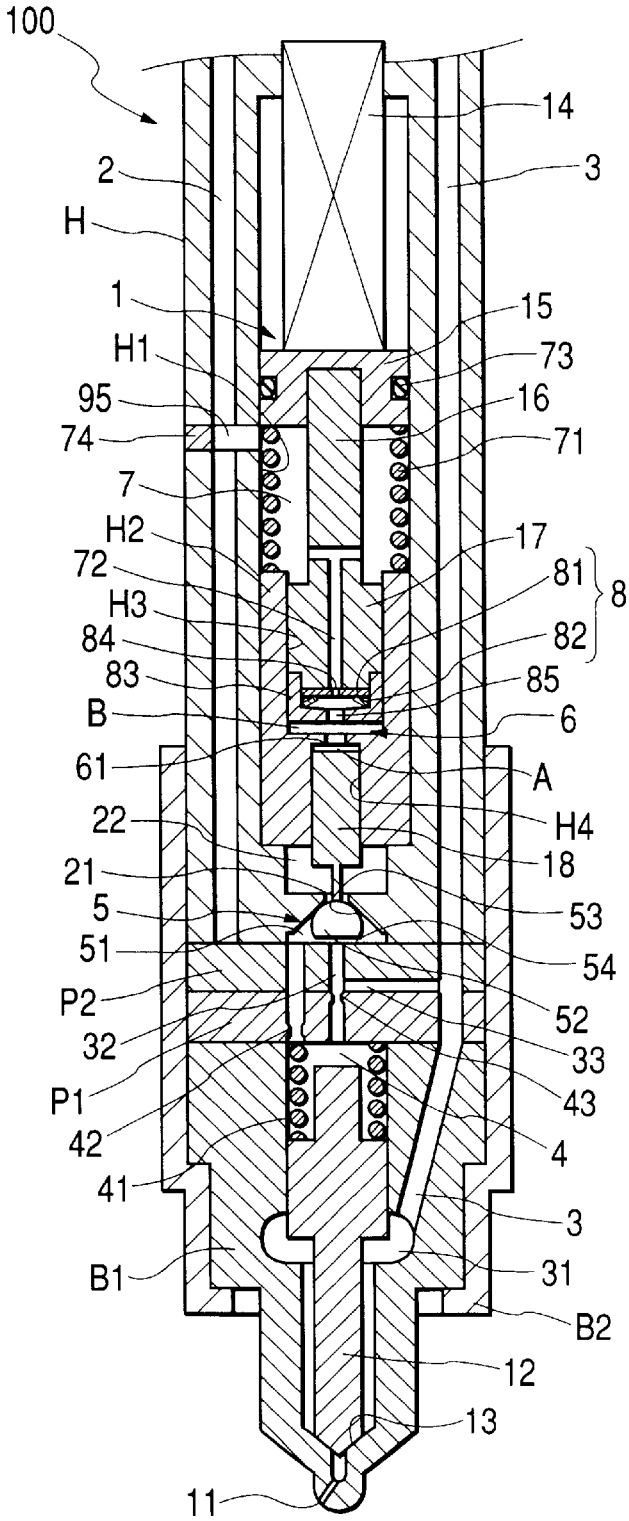
FIG. 1 is a vertical sectional view which shows a fuel injector equipped with a valve actuating device according to the first embodiment of the invention.

Referring to the drawings, wherein like reference numbers refer to like parts in several views, particularly to FIG. 1, there is shown a fuel injector 100 according to the invention. The following discussion will refer to, as an example, a common rail fuel injection system in which the fuel injector 100 is provided for each cylinder of a diesel engine. The common rail fuel injection system includes a common rail which accumulates therein fuel supplied from a fuel tank elevated in pressure by a fuel pump installed on the engine. When it is required to inject the fuel into the engine, the fuel stored in the common rail is supplied to the fuel injectors 100 under high pressure.

The fuel injector 100 is designed to move a nozzle needle 12 vertically to open or close a spray hole 11 formed in a head of a nozzle body B1 for initiating or terminating fuel injection. The spray hole 11 is opened upon movement of the nozzle needle 12 to an upper limit position and communicates with a fuel sump 31 leading to a high-pressure passage 3, so that the fuel is supplied to the spray hole 11. The spray hole 11 is closed upon movement of the nozzle needle 12 to a lower limit position, so that the communication with the fuel sump 31 is blocked to cut the fuel supply to the spray hole 11. The low limit position of the nozzle needle 12 is defined by a nozzle seat 13 on which the nozzle needle 12 is seated. The upper limit position is defined by an orifice plate P1 disposed above the nozzle body B1.

The nozzle body B1 is installed on a lower end of a housing H of a valve actuating device 1 through orifice plates P1 and P2 and disposed within a nozzle holder B2 in liquid-tight form. The high-pressure passage 3 extends upward from the fuel sump 31 to the common rail through the orifice plates P1 and P2 and the housing H. Within the housing H, a drain passage 2 is formed which leads to the fuel tank. A control chamber 4 is defined between an upper end of the nozzle needle 12 and the orifice plate P1. The nozzle needle 12 is urged downward, as viewed in the drawing, by the spring pressure of a coil spring 41 and the hydraulic pressure within the control chamber 4 to close the spray hole 11 at all times.

The hydraulic pressure in the control chamber 4 is controlled by the activity of a three-way valve 5 of the valve actuating device 1. The three-way valve 5 consists of a conical valve chamber 51 formed in a lower end of the housing H and a ball valve 52. The valve chamber 51 always communicates with the control chamber 4 through a passage extending through the orifice plates P1 and P2 and a main orifice 42 formed in the passage. The valve chamber 51 has two ports: a drain port 21 and a high-pressure port 32. The ball valve 52 closes either the drain port 21 or the high-pressure port 32 at all times, thereby establishing fluid communication between one of the drain port 21 and the high-pressure port 32 and the control chamber 4. The drain port 21 communicates with the drain passage 2 through a spill chamber 22 formed above the valve chamber 51. The high-pressure port 32 extends vertically through the orifice plates P1 and P2 and communicates with the high-pressure passage 3 through a groove 33 formed in a lower end surface of the orifice plate P2.

Specifically, when the valve chamber 51 communicates with the drain port 21, it will cause the control chamber 4 to be decreased in pressure, thereby moving the nozzle needle 12 out of the nozzle seat 13. Alternatively, when the valve chamber 51 communicates with the high-pressure port 32, it will cause the control chamber to be increased in pressure, thereby moving the nozzle needle 12 downward into engagement with the nozzle seat 13. The control chamber 4 communicates directly with the high-pressure passage 3 at all times through a sub-orifice 43 formed in the orifice plate P1. The sub-orifice 43 serves to supply the fuel from the high-pressure passage 3 to the control chamber 4 to reduce a pressure drop in the control chamber 4 at the start of fuel injection for smoothing the movement of the nozzle needle 12, while it works to promote a pressure rise in the control chamber 4 to speed up the movement of the nozzle needle 12 when closing the spray hole 11.

Around an opening of the drain part 21 leading to the valve chamber 51, a conical drain seat 53 is formed. Around the high-pressure port 32 leading to the valve chamber 51, a flat high-pressure seat 54 is formed. The drain seat 53 may alternatively be formed to be flat, while the high-pressure seat 54 may be formed to be conical. This compensates for a lateral shift of the ball valve 52. The pressure in the valve chamber 51 is always higher than the pressure in the drain port 21, so that the ball valve 52 is kept seated on the drain seat 53. The pressure acting on the ball valve 52 to urge it into engagement with the high-pressure seat 54 is provided by a small-diameter piston 18 of the valve actuating device 1.

The valve actuating device 1 includes a piezoelectric actuator 14, an actuator piston 15, a large-diameter piston 17, and the small-diameter piston 18. The piezoelectric actuator 14 is installed in an upper portion of the housing H. The actuator piston 15 is arranged to be movable in contact with a lower end of the piezoelectric actuator 14. The large-diameter piston 17 connects with the actuator piston 15 through a rod 16. The small-diameter piston 18 is moved by the large-diameter piston 17 through a displacement amplifying chamber 6. The piezoelectric actuator 14 is made of a laminated piezoelectric device (also called a piezo stack) which works to expand when electrically charged and contract when discharged. The structure of the piezoelectric device is well known in the art, and explanation thereof in detail will be omitted here. The actuator piston 15 is installed slidably within an actuator cylinder H1 and connects with the large-diameter piston 17 through the rod 16. The large-diameter piston 17 and the small-diameter piston 18 are disposed slidably within a large-diameter cylindrical chamber H3 and a small-diameter cylindrical chamber H4 formed coaxially within a hollow cylinder H2. The rod 16 extends from an upper end surface of the large-diameter piston 17 upwards and is fitted within a lower end surface of the actuator piston 15.

Defined below the lower end of the actuator piston 15 around the rod 16 is an oil sump 7 leading to the drain passage 2. A coil spring 71 is disposed within the oil sump 7 to urge the actuator piston 15 upward together with the large-diameter piston 17. Specifically, the actuator piston 15 and the large-diameter piston 17 are urged upward by the spring 71, so that they may move following the expansion or contraction of the piezoelectric actuator 14. An O-ring 73 is installed in an annular groove formed in a side wall of the actuator piston 15 for protecting the piezoelectric actuator 14 from contamination of working fluid (i.e., the fuel) within the oil sump 7. The oils sump 7 communicates with the drain passage 2 through a passage 95. The passage 95 is formed by drilling side walls of the housing Hand the actuator cylinder H1 and closing a hole formed the housing H using a plug 74.

The hollow cylinder H2 has formed on an inner wall between the small-diameter cylinder chamber H4 and the large-diameter cylinder chamber H3 an inner shoulder working as a stopper 61 which defines an upper limit of the small-diameter piston 18. The small-diameter cylinder chamber H4 and the large-diameter cylinder chamber H3 communicate with each other through a central hole formed in the stopper 61. The small-diameter cylinder chamber H4 defines a hydraulic chamber A between the upper end thereof and the stopper 61. The large-diameter cylinder chamber H3 defines a hydraulic chamber B between the lower end thereof and the stopper 61. The hydraulic chambers A and B define the displacement amplifying chamber 6. The displacement amplifying chamber 6 works to transmit the longitudinal displacement of the large-diameter piston 17 to the small-diameter piston 18. Specifically, the stroke of the large-diameter piston 17 (i.e., the vertical movement of the piezoelectric actuator 14) is amplified through the fuel within the displacement amplifying chamber 6 as a function of a difference in diameter between the large-diameter piston 17 and the small-diameter piston 18 (e.g., two or three times the displacement of the large-diameter piston 17) and transmitted to the small-diameter piston 18. A lower portion of the small-diameter piston 18 lies within the spill chamber 22. The small-diameter piston 18 has a thin head which extends into the drain port 21 and contacts with the ball valve 52.

Figure 2A:
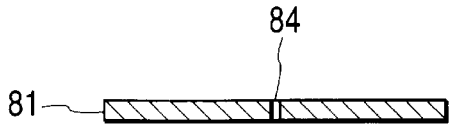
FIG. 2(*a*) is a sectional view which shows a flat valve of a check valve installed in the fuel injector of FIG. 1.
Figure 2B:
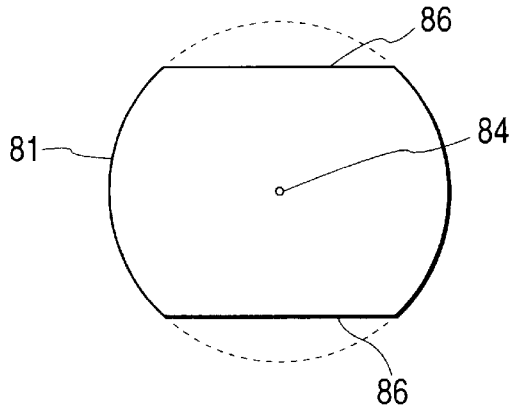
Figure 2C:
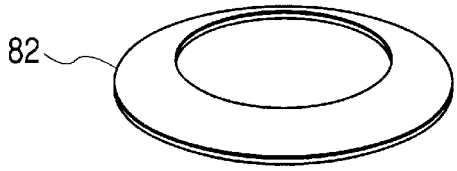

Within the large-diameter piston 18, a vertical passage 72 extends and communicates at an upper end thereof with a lateral passage opening into the oil sump 7. The vertical passage 72 extends at a lower end thereof to the lower end of the large-diameter piston 17 and communicates with the displacement amplifying chamber 6 through a check valve 8 installed on the lower end of the large-diameter piston 17. The check valve 8 works to compensate for a loss of fuel caused by leakage from the oil sump 7 to the displacement amplifying chamber 6 and consists of a flat valve 81 closing the lower opening of the passage 72 and a conical spring 82 urging the flat valve 81 upwards. The flat valve 81 is, as shown in FIGS. 2(*a*) and 2(*b*), made of a thin disc which has a thickness of 0.1 to 0.2 mm and parallel sides 86. A pinhole 84 is formed in the center of the flat valve 81 which has a diameter of 0.02 to 0.5 mm.

The conical spring 82 is, as shown in FIG. 2(*c*), made of an annular plate having a thickness of 0.01 to 005 mm and shaped to produce a pressure of 0.5 to 2N. The flat valve 81 and the conical spring 82 are disposed within a holder 83 made of a cup-shaped cylinder. The holder 83 is fitted on a lower end portion of the large-diameter piston 18. A drop in pressure in the displacement amplifying chamber 6 arising from the leakage of fuel will cause the flat valve 81 to move downward against the pressure produced by the conical spring 82, so that the fuel flows from the passage 72. The holder 83 has formed in the bottom thereof a hole 85 which is much greater than the pinhole 84 and establishes communication between an inner chamber of the holder 83 and the displacement amplifying chamber 6 for facilitating the flow of fuel into the displacement amplifying chamber 6.

Figures 3A, 3B, 3C, 3D, 3E:
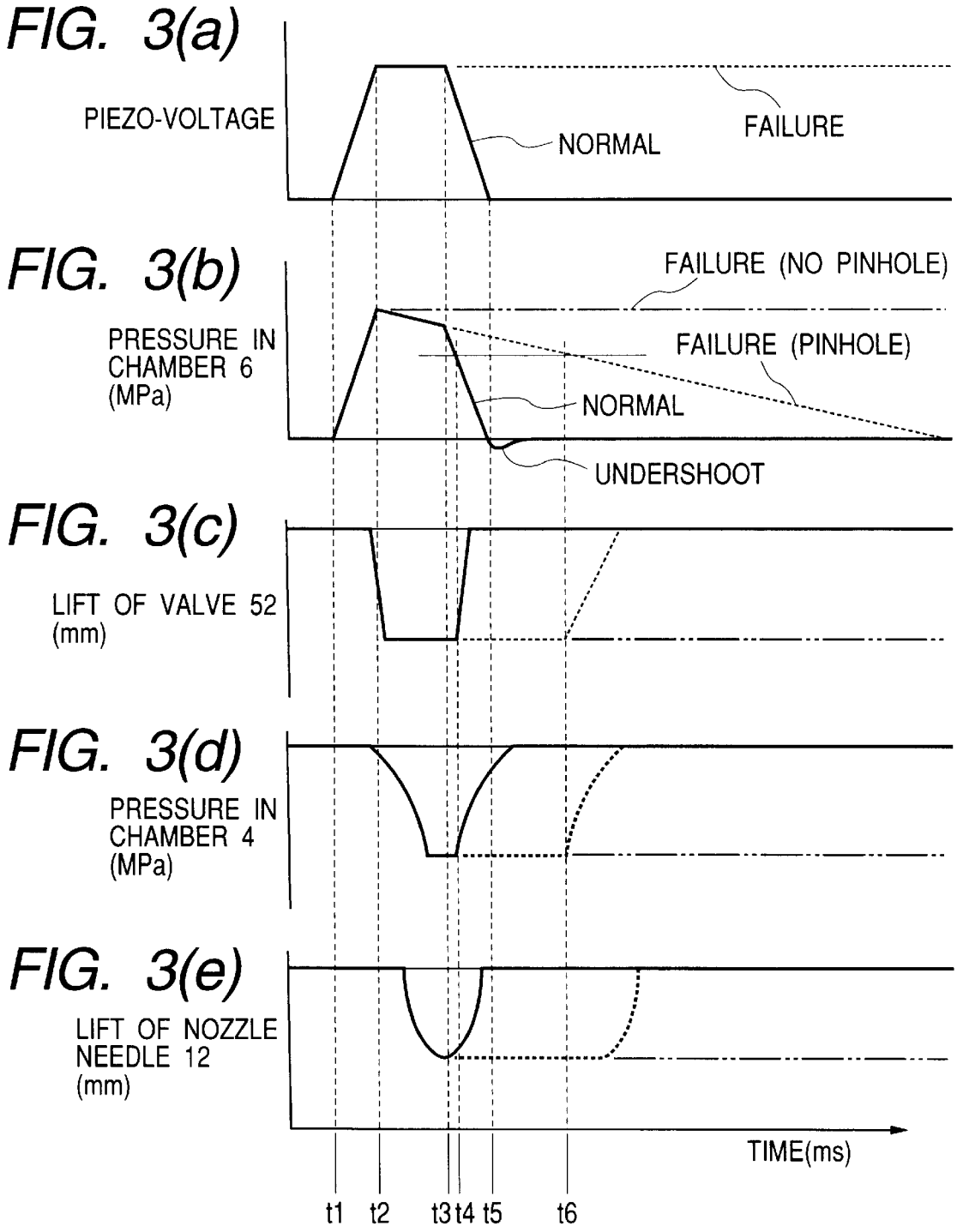
FIG. 3(*a*) is a time chart which shows the voltage applied to a piezoelectric actuator.

In operation of the fuel injector 100, when it is required to initiate the fuel injection, a voltage of about 100 to 150V is, as indicated as a piezo-voltage in FIG. 3(*a*), applied to the piezoelectric actuator 14. The piezoelectric actuator 14 expands, for example, 40 $\mu$m proportional to the applied voltage to move the large-diameter piston 17 downward, thereby elevating, as shown in FIG. 3(*b*), the pressure in the displacement amplifying chamber 6 (time t1 to t2). The pressure in the displacement amplifying chamber 6 leaks into the drain passage 2 through the pinhole 84 of the flat valve 81 and gaps between an outer wall of the large-diameter piston 17 and an inner wall of the hollow cylinder H2 and between an outer wall of the small-diameter piston 18 and the inner wall of the hollow cylinder H2, so that it drops slowly after time t2. The elevation in pressure in the displacement amplifying chamber 6 causes the small-diameter piston 18 to move downward to push the ball valve 52 out of engagement with the drain seat 53, as shown in FIG. 3(*c*). The ball valve 52 then rests on the high-pressure seat 54 (time t2). The degree of movement of the ball valve 52 is a multiple of (e.g., two times) the degree of expansion of the piezoelectric actuator 14 which corresponds to a sectional area ratio of the large-diameter piston 17 to the small-diameter piston 18.

When the ball valve 52 moves out of engagement with the drain seat 53, it establishes communication between the valve chamber 51 and the drain port 21, while it blocks communication between the high-pressure port 32 and the valve chamber 51, so that the pressure in the valve chamber 51 drops, thereby decreasing, as shown in FIG. 3(*d*), the pressure in the control chamber 4. When the pressure in the fuel sump 31 exceeds the sum of the pressure in the control chamber 4 and the pressure produced by the coil spring 41, it will cause the nozzle needle 12 to be lifted upwards, as shown in FIG. 3(*e*), to open the spray hole 11, thereby initiating the fuel injection.

When it is required to terminate the fuel injection, no voltage is applied to the piezoelectric actuator 14 to discharge it electrically (time t3 to t5). The piezoelectric actuator 14 contracts to an original length thereof, thereby causing the actuator piston 15 to be lifted up by the spring 71. The large-diameter piston 17 is also lifted up, thus resulting in a decrease in pressure of the displacement amplifying chamber 6, as shown in FIG. 3(*b*). The drop in pressure in the displacement amplifying chamber 6 causes the small-diameter piston 18 to be moved upward together with the ball valve 52 (time t4).

When the ball valve 52 rests on the drain seat 53 again, it establishes the communication between the valve chamber 51 and the high-pressure port 32, while blocking the communication between the valve chamber 51 and the drain port 21, so that the pressure in the valve chamber 51 and the control chamber 4, as shown in FIG. 3(*d*), is returned to the original level. When the pressure in the control chamber 4 rises, and the pressure urging the nozzle needle 12 downward exceeds the pressure in the fuel sump 31, it will cause the nozzle needle 12 to move downward so that it rests on the nozzle seat 13 again to close the spray hole 11, thereby terminating the fuel injection (time t5). After time t5, the pressure in the displacement amplifying chamber 6 is undershot temporarily by an amount equivalent to a leakage of the fuel during the fuel injection, but the fuel in the oil sump 7 flows into the displacement amplifying chamber 6 through the check valve 8, so that the pressure in the displacement amplifying chamber 6 is, as shown in FIG. 3(*b*), returned quickly to the original level.

In FIGS. 3(*a*) to 3(*e*), dotted lines represent a case where wire connecting an actuator driver and the piezoelectric actuator 14 is broken during the fuel injection. Two-dot chain lines represent a case where the pinhole 84 is not formed in the flat valve 81 of the check valve 8 in such an event.

If the wire connecting the actuator driver and the piezoelectric actuator 14 is broken during application of voltage to the piezoelectric actuator 14, it becomes impossible to discharge the piezoelectric actuator 14, so that the piezo-voltage is kept at a high level, as indicated by the dotted line in FIG. 3(*a*). The displacement or expansion of the piezoelectric actuator 14 is held as it is, thus making it impossible to move the actuator piston 15 and the large-diameter piston 17. In the absence of the pinhole 84, it becomes impossible to change the pressure in the displacement amplifying chamber 6. Specifically, a drop in pressure of the displacement amplifying chamber 6 arises only from leakage of fuel from gaps between the outer walls of the large-diameter piston 17 and the small-diameter piston 18 and the inner wall of the hollow cylinder H2 and continues only for several tens of microseconds (ms). The pressure in the displacement amplifying chamber 6, thus, hardly decreases, as indicated by the two-dot chain line in FIG. 3(*b*), so that the movement of the ball valve 52, the pressure in the control chamber 4, and the movement of the nozzle needle 12 hardly change, which may cause the fuel injection to continue.

In the case where the pinhole 84 is formed in the flat valve 81 of the check valve 8, the piezo-voltage is kept at a high level, but the fuel in the displacement amplifying chamber 6 leaks into the oil sump 7 through the pinhole 84, so that the pressure in the displacement amplifying chamber 6, as indicated by the dotted line in FIG. 3(*b*), drops gradually. 3 to 5 ms after the application of voltage to the piezoelectric actuator 14, the pressure in the displacement amplifying chamber 6 decreases below the pressure in the high-pressure port 32 urging the ball valve 52 upwards, so that the ball valve 52 and the small-diameter piston 18 are lifted upwards together. When the ball valve 52 is seated on the drain seat 53, it blocks the communication between the drain port 21 and the valve chamber 51, so that the pressure in the control chamber 4 is, as indicated by the dotted line in FIG. 3(*d*), elevated. This causes the nozzle needle 12 to be seated, as indicated by the dotted line in FIG. 3(*e*), on the nozzle seat 13 to close the spray hole 11 or terminate the fuel injection.

In the above event, the quantity of fuel that is some multiple or several tens of multiples of normal is supplied to the internal combustion engine. Usually, the fusion of the engine or failure in engine operation occurs when the quantity of fuel that is some multiple of normal is supplied for several revolutions of the engine. Therefore, the fuel injection only for 3 to 5 ms will not be objectionable in the engine operation. It is advisable that the size of the pinhole 84 be selected so that the fuel injection does not continue over a time required for one revolution of the engine running at a maximum speed. For example, when the engine is running at 5000 rpm, the time required for one revolution of the engine is 24 ms. In this case, the size or diameter of the pinhole 84 is preferably set to within a range of 0.02 to 0.2 mm. If the fuel injection is stopped within 24 ms, most of the fuel is discharged to an exhaust pipe of the engine. However, in order to avoid the deterioration of the catalyst, it is advisable that the size of the pinhole 84 be selected so that the fuel injection does not continue over 3 to 5 ms. This may be achieved by setting the size of the pinhole 84 to 0.05 to 0.5 mm.

The pinhole 84 also produces the following effects.

If the displacement amplifying chamber 6 is not filled with the fuel after assembly of the fuel injector 100, it will cause the displacement of the piezoelectric actuator 6 not to be transmitted to the small-diameter piston effectively. Therefore, if the fuel injector 100 is installed in the engine as it is, the displacement amplifying chamber 6 does not work properly until it is filled with the fuel, thus giving rise to a problem that much time is required to start the engine. Such a problem is eliminated by filling the displacement amplifying chamber 6 with fuel before the fuel injector 100 is shipped or installed in the engine. This may be accomplished by connecting a vacuum pump to the high-pressure passage 3 to evacuate the inside of the fuel injector 100 and supply the fuel from the drain passage 2. In the absence of the pinhole 84, it is difficult to evacuate the displacement amplifying chamber 6, so that air is left in the displacement amplifying chamber 6 after the fuel is injected into the displacement amplifying chamber 6, which will impinge upon the transmission of the displacement of the piezoelectric actuator 14 to the small-diameter piston 18 adversely.

In the structure of this embodiment, when the fuel injector 100 starts to be evacuated by a vacuum pump from the high-pressure passage 3, the control chamber 4, the valve chamber 51, the drain port 21, the spill chamber 22, the drain passage 2, the oil sump 7, the passage 72, and the displacement amplifying chamber 6 are, in sequence, evacuated through the pinhole 84. By injecting the fuel from the drain passage 2, the displacement amplifying chamber 6 is filled with the fuel quickly. After the displacement amplifying chamber 6 is filled with the fuel, openings of the high-pressure passage 3 and the drain passage 2 are plugged using, for example, rubber cups in order to avoid the leakage of fuel from the displacement amplifying chamber 6. Usually, a protective cup is fitted on the nozzle head of the fuel injector 100 at the factory. When installed in the engine, the fuel injector 100 is secured in a cylinder head of the engine with the high-pressure passage 3 and the drain passage 2 plugged. Subsequently, they are unplugged and connected to fuel pipes.

The small-diameter piston 18 may fall by its own weight as the time goes by after the engine is stopped. In this case, an amount of fuel equivalent to the fall of the small-diameter piston 18 is supplied to the displacement amplifying chamber 6 from the drain passage 2 through the check valve 8, thereby resulting in a difficulty in lifting up the small-diameter piston 18. Specifically, when the engine is started, the dynamic pressure of fuel supplied from the high-pressure passage 3 works to lift up the ball valve 52 and the small-diameter piston 18. In the absence of the pinhole 84, the displacement amplifying chamber 6 is closed completely, thereby holding the small-diameter piston 18 from being lifted up. Therefore, the ball valve 52 is allowed to move from the high-pressure seat 54 slightly, but does no rest on the drain seat 53. This causes the fuel in the high-pressure passage 3 to continue to flow into the drain passage 2, so that a desired pressure (e.g., 10 to 20 Mpa) is not reached in the control chamber 4, thus encountering a difficulty in starting the engine.

In the structure of this embodiment, the pinhole 84 is formed in the flat valve 81 of the check valve 8, so that the fuel in the displacement amplifying chamber 6 flows into the drain passage 2 through the pinhole 84 quickly, thereby allowing the small-diameter piston 18 and the ball valve 52 to be lifted up. Thus, when the engine is started, the ball valve 52 is seated on the drain seat 53 quickly, thereby enabling proper fuel injection.

Figure 4A:
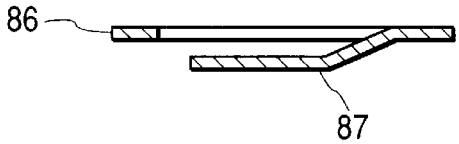
FIG. 4(*a*) is a sectional view which shows a spring which may be used instead of the conical spring of FIG. 2(*c*)
Figure 4B:
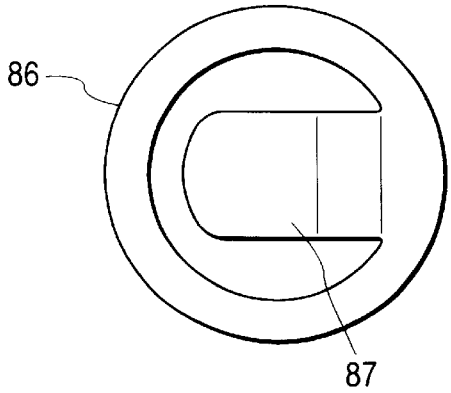

In the embodiment as described above, the conical spring 82 is used to press the flat valve 81 of the check valve 8 against the lower end of the large-diameter piston 17, but a circular short spring may alternatively be used. For example, a spring disc 86, as shown in FIGS. 4(*a*) and 4(*b*), may be used which consists of an annular plate and a tongue 87 which extends from an inner periphery of the annular plate in a radius direction and is bent at a given angle.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims. For example, the three-way valve 5 is used to open and close the spray hole 11 formed in the head of the nozzle body B1, however, the invention is not limited to the same. Another known mechanism such as a two-way valve may be used to open and close the spray hole 11. Further, the piezoelectric actuator 14 is implemented by a piezoelectric device, however, another element such as a solenoid or a magnetostrictor may be used.

What is claimed is:

1. A valve actuating device comprising:

an actuator;

a first piston displaced by said actuator;

a second piston operating a valve, said second piston being smaller in diameter than said first piston;

a displacement amplifying chamber provided between said first piston and said second piston, said displacement amplifying chamber being filled with working fluid to amplify and transmit displacement of said first piston to said second piston; and a drain passage communicating with said displacement amplifying chamber through a pinhole for draining the working fluid within the displacement amplifying chamber, wherein said drain passage communicates with the displacement amplifying chamber through the pinhole at all times.

2. A valve actuating device as set forth in claim 1, wherein the diameter of the pinhole is within 0.02 to 0.5 mm.

3. A valve actuating device as set forth in claim 1, further comprising a check valve disposed between said displacement amplifying chamber and said drain passage which allows the working fluid to flow only from said drain passage to said displacement amplifying chamber, said check valve including a flat valve in which said pinhole is formed.

4. A valve actuating device as set forth in claim 1, wherein said first piston has formed therein a passage leading to said drain passage, and wherein said pinhole is provided between said passage and said displacement amplifying chamber.

5. A valve actuating device comprising:

an actuator;

a first piston displaced by said actuator;

a second piston operating a valve, said second piston being smaller in diameter than said first piston;

a displacement amplifying chamber provided between said first piston and said second piston, said displacement amplifying chamber being filled with working fluid to amplify and transmit displacement of said first piston to said second piston;

a drain passage communicating with said displacement amplifying chamber through a pinhole for draining the working fluid within the displacement amplifying chamber; and a check valve disposed between said displacement amplifying chamber and said drain passage which allows the working fluid to flow only from said drain passage to said displacement amplifying chamber, said check valve including a flat valve in which said pinhole is formed.

6. A valve actuating device comprising:

an actuator;

a first piston displaced by said actuator;

a second piston operating a valve, said second piston being smaller in diameter than said first piston;

a displacement amplifying chamber provided between said first piston and said second piston, said displacement amplifying chamber being filled with working fluid to amplify and transmit displacement of said first piston to said second piston; and a drain passage communicating with said displacement amplifying chamber through a pinhole for draining the working fluid within the displacement amplifying chamber, wherein said first piston has formed therein a passage leading to said drain passage, and wherein said pinhole is provided between said passage and said displacement amplifying chamber.

7. A valve actuating device as set forth in claim 6, wherein said first piston has a length in which said passage extends longitudinally and has an opening formed in a first end of the length exposed to said displacement amplifying chamber, and wherein the flat valve of said check valve is disposed on the opening of said passage to allow the working fluid to flow only from said drain passage to said displacement amplifying chamber through said passage, said pinhole being formed in the flat valve of said check valve.

8. A valve actuating device as set forth in claim 6, further comprising an oil sump which is formed on a side of a second end of said first piston opposite the first end and establishes fluid communication between said drain passage and said passage.

9. A valve actuating device as set forth in claim 8, further comprising a spring chamber formed on the side of the first end of said first piston in which a spring is disposed to urge said actuator away from said displacement amplifying chamber, said spring chamber defining said oil sump.

10. A fuel injector comprising:

an injector body;

a fuel inlet passage formed in said injector body;

an actuator;

a first piston displaced by said actuator;

a second piston smaller in diameter than said first piston, said second piston operating a valve for spraying fuel supplied from said fuel inlet passage from a spray hole;

a displacement amplifying chamber formed between said first piston and said second piston within said injector body, said displacement amplifying chamber being filled with working fluid to amplify and transmit displacement of said first piston to said second piston; and a drain passage formed in said injector body which communicates with said displacement amplifying chamber through a pinhole for draining the working fluid within the displacement amplifying chamber, wherein said drain passage communicates with the displacement amplifying chamber through the pinhole at all times.

11. A fuel injector as set forth in claim 10, wherein the diameter of the pinhole is within 0.02 to 0.5 mm.

12. A fuel injector as set forth in claim 10, further comprising a check valve disposed between said displacement amplifying chamber and said drain passage which allows the working fluid to flow only from said drain passage to said displacement amplifying chamber, said check valve including a flat valve in which said pinhole is formed.

13. A fuel injector as set forth in claim 10, wherein said first piston has formed therein a passage leading to said drain passage, and wherein said pinhole is provided between said passage and said displacement amplifying chamber.

14. A fuel injector as set forth in claim 13, wherein said first piston has a length in which said passage extends longitudinally and has an opening formed in a first end of the length exposed to said displacement amplifying chamber, and wherein the flat valve of said check valve is disposed on the opening of said passage to allow the working fluid to flow only from said drain passage to said displacement amplifying chamber through said passage, said pinhole being formed in the flat valve of said check valve.

15. A fuel injector as set forth in claim 13, further comprising an oil sump which is formed on a side of a second end of said first piston opposite the first end and establishes fluid communication between said drain passage and said passage.

16. A fuel injector as set forth in claim 15, further comprising a spring chamber formed on the side of the first end of said first piston in which a spring is disposed to urge said actuator away from said displacement amplifying chamber, said spring chamber defining said oil sump.

* * * * *